US005345048A

United States Patent [19]

Towey, Jr.

[11] Patent Number: 5,345,048

[45] Date of Patent: Sep. 6, 1994

[54] ELEVATOR SPEED CHECK USING CONSTANT RATIOMETRIC COMPARISON

[75] Inventor: James P. Towey, Jr., Bristol, Conn.

[73] Assignee: Otis Elevator Company, Farmington, Conn.

[21] Appl. No.: 126,446

[22] Filed: Sep. 24, 1993

Related U.S. Application Data

[63] Continuation of Ser. No. 919,315, Jul. 27, 1992, abandoned.

[51] Int. Cl.[5] ..... B66B 5/06

[52] U.S. Cl. ..... 187/116; 187/105; 187/130

[58] Field of Search ..... 187/116, 117, 130, 140, 187/105

[56] References Cited

U.S. PATENT DOCUMENTS 4,085,823 4/1978 Caputo et al. ..... 187/116
4,503,939 3/1985 Lawrence et al. ..... 187/116
4,869,347 9/1989 Takahashi et al. ..... 187/116

*Primary Examiner*—Steven L. Stephan
*Assistant Examiner*—Robert Nappi
*Attorney, Agent, or Firm*—M. P. Williams

[57] ABSTRACT

The emergency terminal stopping speed is checked by comparing (30) the number of pulses (26) provided by an encoder (10) driven by the elevator motor (12) with a fixed number (36) which for the particular elevator will correspond to the maximum allowable speed when received within a time frame determined by the overflow (46) from a presettable (44) counter (40). The time period is adjusted for each elevator installation so that the fixed number of pulses relate to the desired speed by adjusting the preset of the presettable counter. Floor leveling speed is also determined by comparing (32) the counted number of pulses with a settable (38) number.

8 Claims, 1 Drawing Sheet

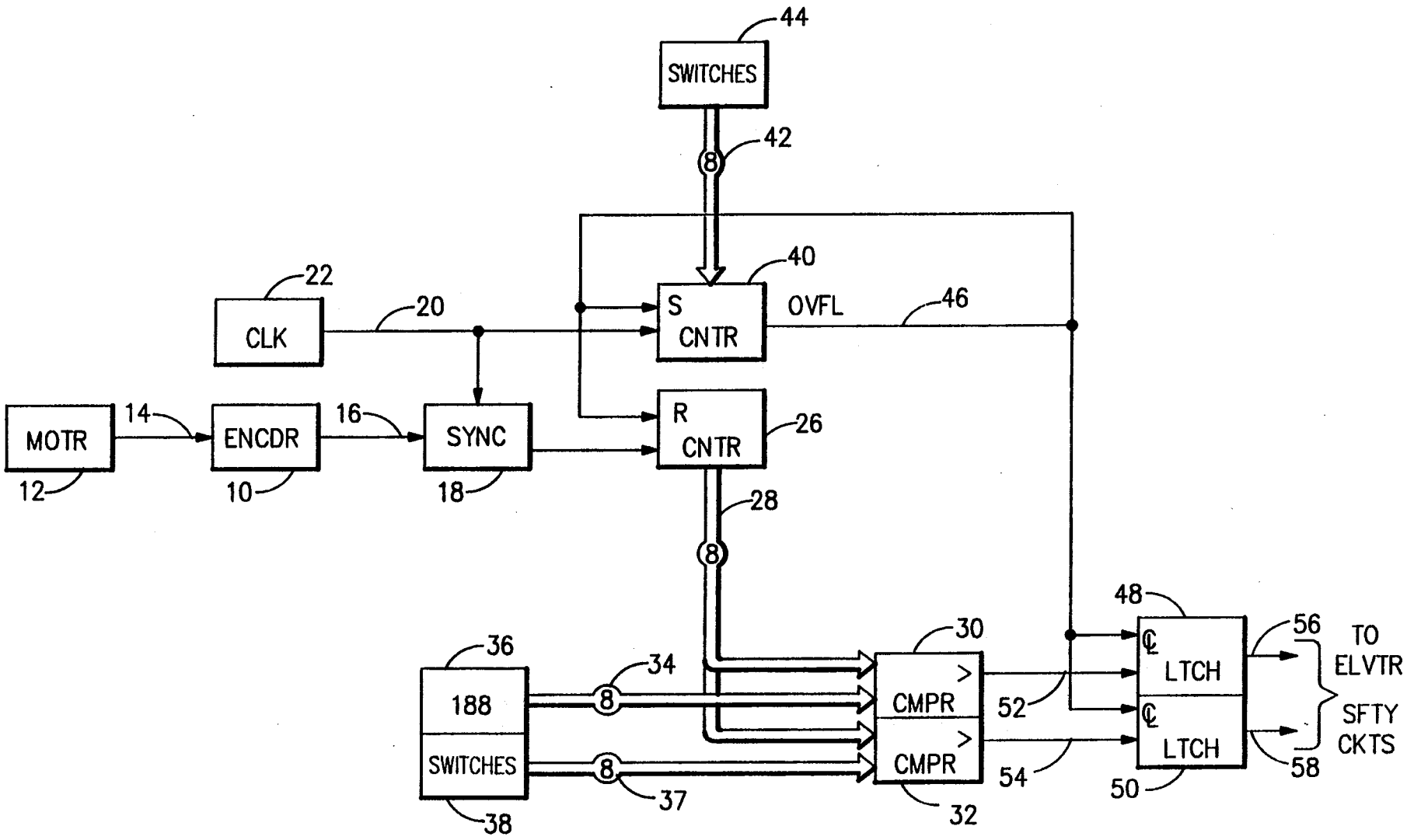
MOTR
12
14
ENCDR
10
16
CLK
22
20
SYNC
18
SWITCHES
44
42
8
S
CNTR
40
OVFL
46
R
CNTR
26
28
8
34
8
37
8
36
188
SWITCHES
38
CMPR
30
CMPR
32
52
54
LTCH
48
LTCH
50
56
58
TO ELVTR
SFTY CKTS

ELEVATOR SPEED CHECK USING CONSTANT RATIOMETRIC COMPARISON

This is a continuation of application Ser. No. 07/919,315, filed Jul. 27, 1992, now abandoned.

TECHNICAL FIELD

This invention relates to elevator safety speed checking which is readily adaptable to a variety of elevator configurations and speeds, and has low data latency and adequate accuracy.

BACKGROUND ART

Certain elevator safety code regulations (such as ANSI A17.1) require checking speed, to determine an adequately slow speed before the doors are opened at a landing and to ensure that the elevator is slowing down as it approaches a terminal landing, by means which are in addition to the normal speed measurement utilized in the operational control of the elevator. It has heretofore been common to provide both of these speed checks based upon an encoder mounted to the elevator motor shaft. In low cost systems, the encoder output frequency has typically been converted to a voltage for comparison with a predetermined voltage indicative of the maximum safe speed being checked. Analog systems have very poor system-to-system repeatability, and lose accuracy over lifetime due to component aging and the effects of working in a high noise environment. Other systems utilize digital comparison of the count produced by said frequency over a known time interval with a count indicative of the maximum safe speed being checked. Digital systems of this type may have accuracy limited to between 2% and 5%, and may typically have data latency (the delay in sensing an overspeed after it occurs) on the order of 60 milliseconds. This can be inadequate for certain applications. The data latency is due at least in part to the length of time that the actual encoder output stream is measured; for instance, if it takes a half minute to make the measurement, the result is always a half minute late from the occurrence of an excess that will show up in the measurement. By increasing the frequency or reducing the number of counts which are counted, one can reduce the latency; but increasing the frequency requires a much greater increase in the bit capacity of all of the involved hardware or software, and reducing the number of counts checked reduces the accuracy even further. It is conceivable that among various systems with which a speed checker is to work, the number of counts can vary from on the order of 100 to on the order of several thousand; for the comparator to be universal for either application, it must be able to accommodate counts in excess of 1,000 in such a case; such a comparator is therefore wasting 90% of the hardware if it is operating at on the order of 100 counts.

DISCLOSURE OF INVENTION

Objects of the invention include providing speed checking which is readily adapted for use with a variety of elevator system configurations, including different elevator car speeds, gear ratios, roping ratios, and the like.

According to the present invention, elevator safety speed checking utilizes pulses from an encoder that is journaled to provide an output indicative of elevator motor speed, the threshold speed being identified by comparison with a fixed number of counts which occur over a time period which is varied to accommodate the encoder pulse rate vs. elevator speed variations and rated speed variations which occur in different elevator installations. According further to the invention, the door leveling speed (which is a very low, fixed speed) for which the system must check, is accommodated with the variable pulse count measurement period by adjusting the threshold count used therefor in a manner which is directly related to the time frame adjustment utilized for measuring terminal speed. In accordance still further with the invention, data latency is reduced by use of relatively high frequency pulses, a short counting period, and an essentially instantly available output.

Providing comparisons within the same relative number of bits for the high speed, emergency terminal speed check allows speed and accuracy without utilizing excess hardware.

The invention can readily achieve latencies of less than 20 milliseconds and achieve accuracy factors very close to one percent. The invention may be implemented utilizing electronic apparatus which is readily available in accordance with known techniques, in light of the teachings which follow hereinafter.

Other objects, features and advantages of the present invention will become more apparent in the light of the following detailed description of exemplary embodiments thereof, as illustrated in the accompanying drawing.

BRIEF DESCRIPTION OF THE DRAWINGS

The sole Figure herein is a simplified block diagram of a speed checking apparatus in accordance with the present invention.

BEST MODE FOR CARRYING OUT THE INVENTION

An encoder 10 is capable of providing a given number of pulses per revolution of an elevator drive motor 12 to which it is suitably journaled by mechanical means 14, such as by being attached to the shaft of the motor, on a line 16 to a synchronizer 18 that synchronizes the pulses to a clock signal on a line 20 from a clock circuit 22. The encoder 10 may simply be the pulse generator portion of a tachometer or of an incremental rotary position encoder. The clock circuit may, for instance, comprise a 3.579 megahertz crystal control square wave oscillator with a 256 divider to produce 13.98 kilohertz on the line 20. The synchronized pulses are provided from the synchronizer 18 on a line 24 to the lock input (the counting input) of a digital up-counter 26, the output of which on a trunk of lines 28 is provided to a pair of comparators 30, 32. The other input to the comparator 30 is depicted as a trunk of eight lines 34 which are connected to hard wired terminals 36 in a configuration to provide to the comparator 30 the decimal number 188. This is not a mandatory number, but it provides improved operation by avoiding truncation errors, as determined empirically. In reality, if the maximum count for the highest speed to be measured were taken to be 256 counts (0–255 in a 8-bit register) for a speed of 125% of maximum rated speed, then the counts required to equal 94% of rated speed (the terminal emergency speed requirement of the ANSI code) would be 191.76 counts. This of course is difficult to achieve; by simply adjusting the period to be slightly smaller (188/191.76), then a count of 188 will equal 94% of rated speed, and the only change in reading the highest possible speed is that the speed can be as high as 127% of rated speed with the maximum count of 255.

The input to the other comparator 32 is a set of switches which can provide values between 0 and 255, the value to be set indicating the ANSI code requirement for door leveling speed which must be achieved near the landing before doors are opened, an excess of which will cause the safety circuits to drop the elevator brake. Of course, instead of hard wires 36 in switches 38, non-volatile registers could be used which would be loaded with an elevator maintenance tool. It suffice that there be a fixed suitable number provided through the trunk of lines 34 and a comparable suitable number adjusted for the particular elevator installation, provided through the trunk of lines 37, in a manner described hereinafter.

To provide the variable time period during which pulses will be counted for the high speed terminal safety speed check, timing circuitry provides signals demarcating the pulse measuring period. The timing circuitry includes a presettable up counter 40 which is preset by a number on a trunk of lines 42 established by switches 44. The counter 40 will count a given number of clock pulses on the line 20 to reach its terminal count and provide an overflow signal on a line 46, indicating the end of the pulse counting period, which is used to test whether or not the number of counts have exceeded the permissible number of counts indicative of the maximum permitted terminal safety speed and door leveling speed as determined in the comparators 30 and 32. This is achieved by providing the overflow signal on the line 46 as the clocking input to a pair of latches 48, 50 which will memorialize the fact that the respective count is excessive, whenever that is so, as indicated by a signal on either of the lines 52, 54 from the "greater than" outputs of the comparators 30, 32. The output of either latch 48, 50 on lines 56, 58 appears only after concurrent presence of both an overflow signal and a clock signal, and once latched, will remain until the next clock signal. Otherwise, the clocking of the latches 48, 50 will either reset the latch from ON to OFF or have no effect if the count indicated by either comparator 30, 32 is not excessive. Each time that the overflow signal appears on the line 46, it also causes the counter 26 to be reset to zero, and causes the preset value on the trunk of lines 42 to be reestablished in the counter 40.

Note that the comparison is taking place all the time in each of the comparators 30, 32, and a signal from either one of them (indicating the speed is excessive can occur at any time). In fact, the comparator 32 will be producing signals on its output line 54 almost all the time, except just before, during, and just after the elevator stops. However, the signals on the lines 56, 58 are ignored by the safety circuits, other than when approaching a terminal landing or during the leveling operation, respectively. The process of latching the indication of unsafe speed may, in some installations, require the use of different phases of the clock signal to ensure that the circuitry operates in the correct order. However, it is possible that in some cases, a single clock signal (such as that on the line 20) is adequate, and the overflow signal may or may not be gated with signals of different phase from the clock circuit. For instance, when the overflow occurs, the latches 48, 50 can be clocked by the overflow signal even though at the same moment in time, the counter 26 is being reset by the same signal; the reason is that there are circuit delays through the comparators, so that the clocking of the latches 48, 50 will occur before the signals on lines 52, 54 disappear. The timing means may employ decoding of the count output of a counter, rather than using the overflow from a preset number.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A safety speed checking apparatus for use with elevators of the type having a motor which drives a sheave that is roped to the elevator car to provide upward and downward motion thereto, comprising:

an encoder which, when said apparatus is installed for checking the speed of an elevator, is connected to the motor thereof to provide a given number of pulses for each rotation of said motor;

a resettable counter disposed to count said pulses emanating from said encoder and providing a digital output signal indicative of the number of pulses counted since being reset;

a comparator for comparing said digital output signal with a digital reference signal indicative of a predetermined fixed number invariant for all elevator installations in which said apparatus may be used which represents a number of pulses to be received corresponding to the safe speed of the elevator for which the apparatus performs the safety speed check, said comparator providing an output signal in the event that said digital number exceeds said predetermined number; and timing circuitry for providing a timing signal demarcating a predetermined period of time, the extent of said predetermined period of time being variably established for the particular elevator installation in which said apparatus is used so that said predetermined fixed invariant number of pulses emanating from said encoder within said predetermined period of time is indicative of exceeding said safe speed for said particular elevator.

2. Apparatus according to claim 1 including:

operator controlled means associated with said timing circuitry for establishing the extent of said predetermined time period.

3. Apparatus according to claim 1 including:

a latch connected to the output of said comparator and to said timing circuitry for latching said output signal, in response to said timing signal, whenever said output signal is present at the end of said predetermined time period.

4. Apparatus according to claim 1 including:

a second comparator connected to said counter for comparing said digital number to a second predetermined number which is established with respect to said predetermined time period so that said second predetermined number of pulses emanating from said encoder within said predetermined time period indicates a speed equivalent to the maximum safe door leveling speed for which said apparatus is checking, and providing an output signal indicative thereof.

5. Apparatus according to claim 4 including:

operator controlled means associated with said second comparator for establishing said second predetermined number.

6. Apparatus according to claim 4 including:

a latch connected to the output of said second comparator and to said timing circuitry for latching said second output signal, in response to said timing signal, whenever said second output signal is present at the end of said predetermined time period.

7. A method of performing safety speed checks of the maximum allowable emergency terminal stopping speed of an elevator having a motor which drives a sheave that is roped to the elevator car to provide upward and downward motion thereto and having an encoder connected to the elevator drive motor which provides a given number of pulses for each revolution of the elevator drive motor, comprising:

counting the number of pulses provided by said encoder during a predetermined time period, and providing a signal indication of the speed of the elevator being in excess of the maximum allowable emergency terminal stopping speed in the event that said number of pulses exceeds a predetermined fixed number which is invariant in any elevator installation and which corresponds to the maximum permissible emergency terminal stopping speed of said elevator, wherein said predetermined time period is adjusted for each elevator installation so that said predetermined fixed number of pulses corresponds to the specific maximum permissible emergency terminal stopping speed of said elevator installation with the specific given number of pulses for each revolution of said motor in said elevator installation.

8. The method according to claim 7 including:

comparing the number of pulses provided by said encoder within said predetermined time period with a second predetermined number which is set, in any given elevator installation, to correspond to the maximum permissible floor leveling speed for said specific elevator installation with said predetermined time period, and providing a signal indication of the speed of the elevator being in excess of the maximum allowable door leveling speed for said elevator in the event that said number of pulses exceeds said second predetermined number.

* * * * *